US006126101A

United States Patent [19]

Ostergaard

[11] Patent Number: 6,126,101

[45] Date of Patent: Oct. 3, 2000

[54] DOUBLE WEDGE KEY PLATES FOR A JAW CRUSHER

[75] Inventor: David A. Ostergaard, Cedar Rapids, Iowa

[73] Assignee: Cedarapids, Inc., Cedar Rapids, Iowa

[21] Appl. No.: 09/272,934

[22] Filed: Mar. 20, 1999

[51] Int. Cl.[7] ..... B02C 1/10

[52] U.S. Cl. ..... 241/264; 29/525

[58] Field of Search ..... 241/264–265, 241/300, 291; 29/525

[56] References Cited

U.S. PATENT DOCUMENTS

| | | | |
|---|---|---|---|
| 3,984,058 | 10/1976 | Archer et al. | 241/264 |
| 5,172,869 | 12/1992 | Kitsukawa et al. . | |
| 5,630,555 | 5/1997 | Boyd . | |
| 5,772,135 | 6/1998 | Styles . | |
| 5,799,888 | 9/1998 | Hamaguchi et al. . | |
| 5,802,747 | 9/1998 | Nojima . | |
| 5,857,630 | 1/1999 | Hamaguchi et al. . | |

*Primary Examiner*—Mark Rosenbaum

*Attorney, Agent, or Firm*—Marshall, O'Toole, Gerstein, Murray & Borun

[57] ABSTRACT

A jaw crusher having device for securing the stationary jaw to the frame against side-to-side movement is disclosed. The jaw crusher includes a frame having a generally vertical base extending between a pair of spaced apart side portions, with each of the side portions including an angled ledge spaced from the base. A generally planar stationary jaw is mounted to the base and extends between the frame side portions, with the stationary jaw having a top edge, a bottom edge, and interconnecting side edges. Each of the stationary jaw side edges includes a beveled lug extending along its length. A pair of generally wedge shaped key plates are provided, with each of the key plates being mountable to an adjacent frame side portion and including a beveled first edge adapted to engage an adjacent beveled side lug of the stationary jaw. Each of the key plates further includes a second edge adapted to engage an adjacent ledge of the frame side portion. Accordingly, in response to downward movement of the key plates the stationary jaw is pressed generally horizontally against the frame base with the engaging beveled surfaces of the key plates and the side lugs cooperating to prevent side-to-side movement of the stationary jaw.

15 Claims, 4 Drawing Sheets

DOUBLE WEDGE KEY PLATES FOR A JAW CRUSHER

FIELD OF THE INVENTION

The present invention relates to jaw crushers for crushing aggregate material and having a stationary crushing jaw and a moveable crushing jaw. More specifically, the present invention relates to an improved double wedge key plate device for securing the stationary jaw to the frame of the jaw crusher thereby preventing unwanted side-to-side movement of the stationary jaw during operation of the crusher.

BACKGROUND OF THE INVENTION

A typical jaw crusher includes a stationary jaw and a moveable jaw spaced to define a crushing chamber in between. The jaws each include a face having a series of generally vertical corrugations. Aggregate material is fed into the crushing chamber and is crushed by the intermeshing corrugations as the moveable jaw is moved repeatedly toward and away from the stationary jaw.

The jaws experience tremendous forces during operation of the crusher, and it is thus important that the stationary jaw be firmly secured to the crusher frame during operation. For example, due to the angle between the moveable jaw and the stationary jaw, the moveable jaw applies a cyclic upward load against the stationary jaw. Accordingly, the stationary jaw must be firmly secured against vertical movement. Moreover, due to the aggregate being wedged between the opposing corrugations, the repeated cyclic load applied against the stationary jaw also tends to shift the stationary jaw horizontally (i.e., from side to side within the crusher frame in a direction generally perpendicular to the frame sidewalls). Any undesired movement of the stationary jaw, whether vertical or side-to-side, leads to excess wear and tear on the stationary jaw and the crusher frame, increased down time, and hence increased operational cost of the crusher. It is thus important that the stationary jaw be firmly secured against any up and down and side-to-side movement.

On a typical jaw crusher, and as shown in FIG. 4, the stationary jaw 112 is secured to a portion of the frame 120 against side-to-side movement using wedge shaped key plates 132 which bear against vertical lugs 154, 158 on each side of the stationary jaw 112. After the stationary jaw 112 is positioned on the crusher frame 120, the key plates 132 are driven downwardly and secured to the crusher sidewalls 122, 124, such that the stationary jaw 112 is secured by friction between the stationary jaw side lugs 154, 158 and the corresponding edges 155, 157 on the adjacent key plates. The key plates are then bolted to the crusher sidewalls.

Unfortunately, the high side-to-side forces applied to the stationary jaw during operation of the crusher may sometimes overcome the frictional connection between the key plates and the lugs on the side of the stationary jaw, resulting in side-to-side movement of the stationary jaw. In the event the force on the frictional connection is increased, the side-to-side forces may be sufficient to break the connecting bolts used to secure the key plates to the crusher sidewalls. If so, any movement of the stationary jaw both reduces crushing forces and also damages the crusher frame due to the peening effect caused by the jaw repeatedly pounding against the frame.

Accordingly, an improved system for securing the stationary jaw against side-to-side movement is desired.

SUMMARY OF THE INVENTION

A device for securing the stationary jaw to the frame of a jaw crusher according to the present invention provides better, more positive side-to-side securement of the stationary jaw to the crusher frame, thus increasing the efficiency and prolonging the service life of the crusher.

According to one aspect of the invention, a jaw crusher includes a frame having a generally vertical base extending between a pair of spaced apart side portions, with each of the side portions including an angled ledge spaced from the base. A generally planar stationary jaw is mounted to the base and extends between the frame side portions, with the stationary jaw having a top edge, a bottom edge, and interconnecting side edges. Each of the stationary jaw side edges includes a beveled lug extending along its length. A pair of generally wedge shaped key plates are provided, with each of the key plates being mountable to an adjacent frame side portion and including a beveled first edge adapted to engage an adjacent beveled side lug of the stationary jaw. Each of the key plates further includes a second edge adapted to engage an adjacent ledge of the frame side portion. Accordingly, in response to downward movement of the key plates the stationary jaw is pressed generally horizontally against the frame base with the engaging beveled surfaces of the key plates and the side lugs cooperating to prevent side-to-side movement of the stationary jaw.

In further accordance with a preferred embodiment, each key plate is adapted for connection to its adjacent frame side portion, such as by a plurality of bolts or fasteners. Moreover, the bevel on each side lug of the stationary jaw is angled to match the bevel on the first side edge of the adjacent key plate. Each key plate thus cooperates with its opposing key plate to apply a centering force to the stationary jaw, which centering force may be steplessly increased in response to downward movement of the key plates. Each key plate may be divided into a top portion and a bottom portion, with each top and bottom portion being independently mountable to its adjacent frame side portion.

According to another aspect of the invention, a jaw crusher includes a frame having a mounting base extending between a pair of spaced apart sidewalls, with each of the sidewalls including a ledge spaced from, and being angled relative to, the mounting base. A stationary jaw is mounted to the mounting base and extends between the frame sidewalls. The stationary jaw includes a top edge, a bottom edge, and interconnecting side edges, with a portion of each jaw side edge defining a beveled lug. A generally wedge shaped key plate is vertically and removably mounted to each of the frame sidewalls. Each key plate includes a beveled first edge adapted to engage an adjacent beveled side lug of the stationary jaw, and each key plate further includes a second edge adapted to engage an adjacent ledge of the frame sidewall. Each key plate is downwardly moveable to thereby force the jaw against the mounting base, with the beveled first edge of each key plate cooperating with its adjacent beveled side lug to thereby prevent side-to-side movement of the stationary jaw.

According to yet another aspect of the invention, a jaw crusher comprises a frame having a generally vertical mounting base extending between a pair of spaced apart sidewalls. Each of the sidewalls includes a ledge spaced from and angled relative to the mounting base. A stationary jaw is mounted to the mounting base and extends between the frame sidewalls, with the stationary jaw having a top edge, a bottom edge, and interconnecting side edges. A pair of generally wedge shaped key plates are provided, with each key plate being vertically and removably mounted to one of the frame sidewalls so as to engage one of the jaw side edges and an adjacent one of the sidewall ledges. Means, carried by cooperating and engaging portions of each key plate and each jaw side edge, are provided for applying a stepless and progressively greater centering force to the jaw in response to downward movement of the key plates.

According to a still further aspect of the invention, on a jaw crusher having a frame, a stationary jaw, and a pair of key plates adapted for vertically sliding engagement with opposing sidewalls of the frame for securing the stationary jaw to the frame, a method of applying a centering force to the stationary jaw comprises the steps of providing a beveled first edge on each of the key plates, providing a beveled side lug on opposing sides of the stationary jaw, sliding each key plate into engagement with the frame such that each beveled first edge engages an adjacent beveled side lug of the stationary jaw, and securing each key plate to its adjacent frame sidewall.

The aforementioned features and advantages, in addition to other features and advantages, will become readily apparent to those skilled in the art upon a reading of the following detailed description.

DETAILED DESCRIPTION OF THE PREFERRED EMBODIMENT

The embodiment described herein is not intended to be exhaustive or to limit the scope of the invention to the precise form disclosed. The following embodiment has been chosen and described in order to best explain the principles of the invention and to enable others skilled in the art to follow its teachings.

Figure 1:
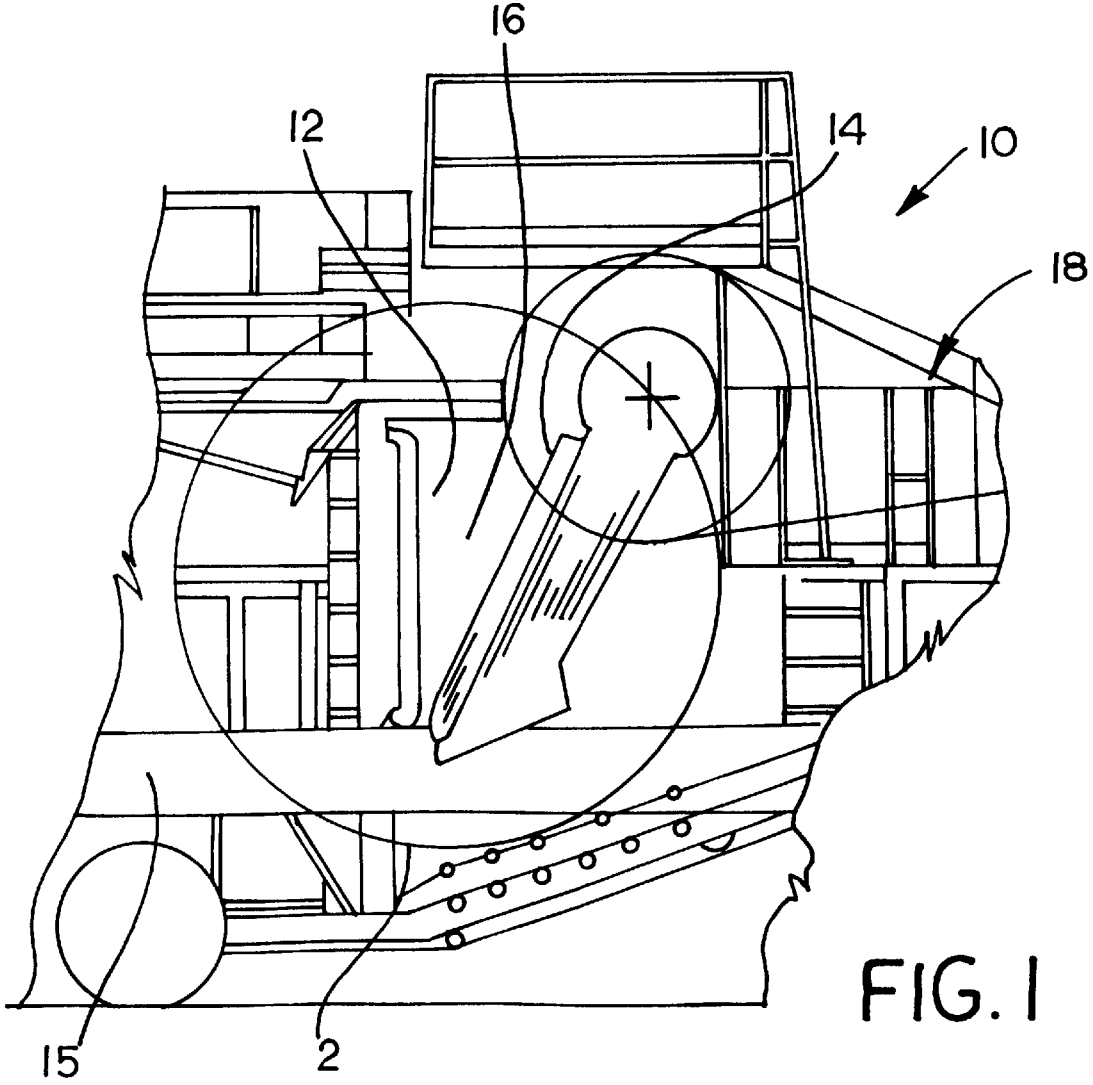
FIG. 1 is a fragmentary elevational view of a typical jaw crusher having a stationary jaw and a moveable jaw and having portions of the sidewall cut away to reveal the stationary jaw and the moveable jaw.

Referring now to the drawings, FIG. 1 illustrates a jaw crusher 10 of the type generally well known in the art. The jaw crusher 10 includes a stationary jaw 12 and a moveable jaw 14, which are mounted to a mounting frame 15 and which are spaced apart to defme a crushing chamber 16 between the stationary jaw 12 and the moveable jaw 14. The jaw crusher 10 also includes a drive system 18 of the type generally well known in the art and which is adapted to reciprocate the moveable jaw 14 back and forth relative to the stationary jaw 12 so as to crush aggregate material fed into the crushing chamber 16 by a conventional feed system. The jaw crusher 10 also includes a variety of other system components (not shown), all of which would be known to those skilled in the art.

The stationary jaw 12 is secured to the frame 15 against vertical movement and against side-to-side movement in any conventional manner. However, a more complete description of one possible manner of securing the stationary jaw 12 to the frame 15 against movement can be found in co-pending U.S. patent application Ser. No. 09/272,991, Attorney Docket No. 29096/35391, entitled "Device for Securing the Stationary Jaw of a Jaw Crusher", the entire disclosure of which is incorporated herein by reference, and which is owned by the assignee of the present application.

Figure 2:
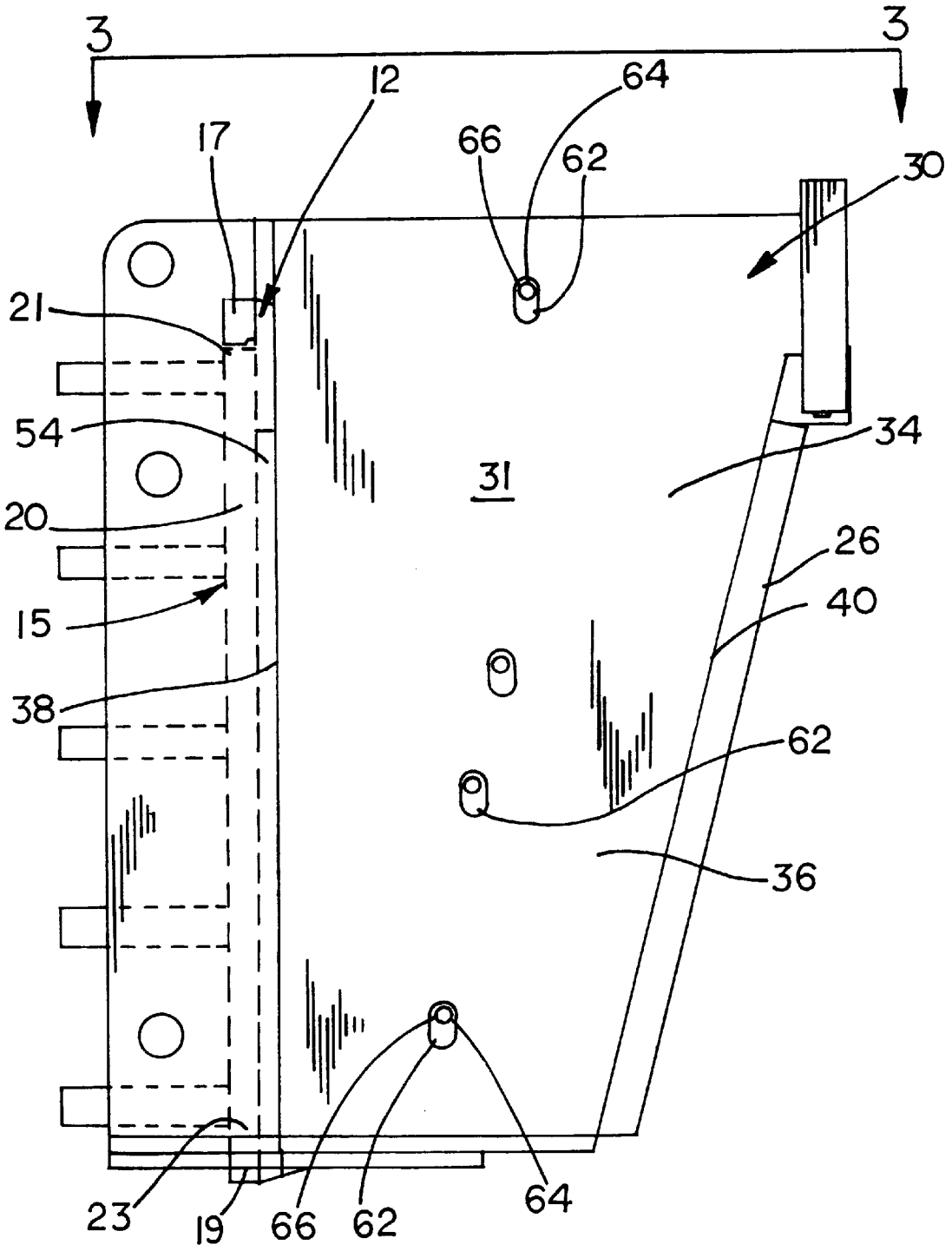
FIG. 2 is an enlarged fragmentary side elevational view taken of the circumscribed portion of FIG. 1 illustrating the key plates constructed in accordance with the teachings of the present invention disposed along one side of the crusher frame so as to engage an angled ledge on the crusher frame.
Figure 3:
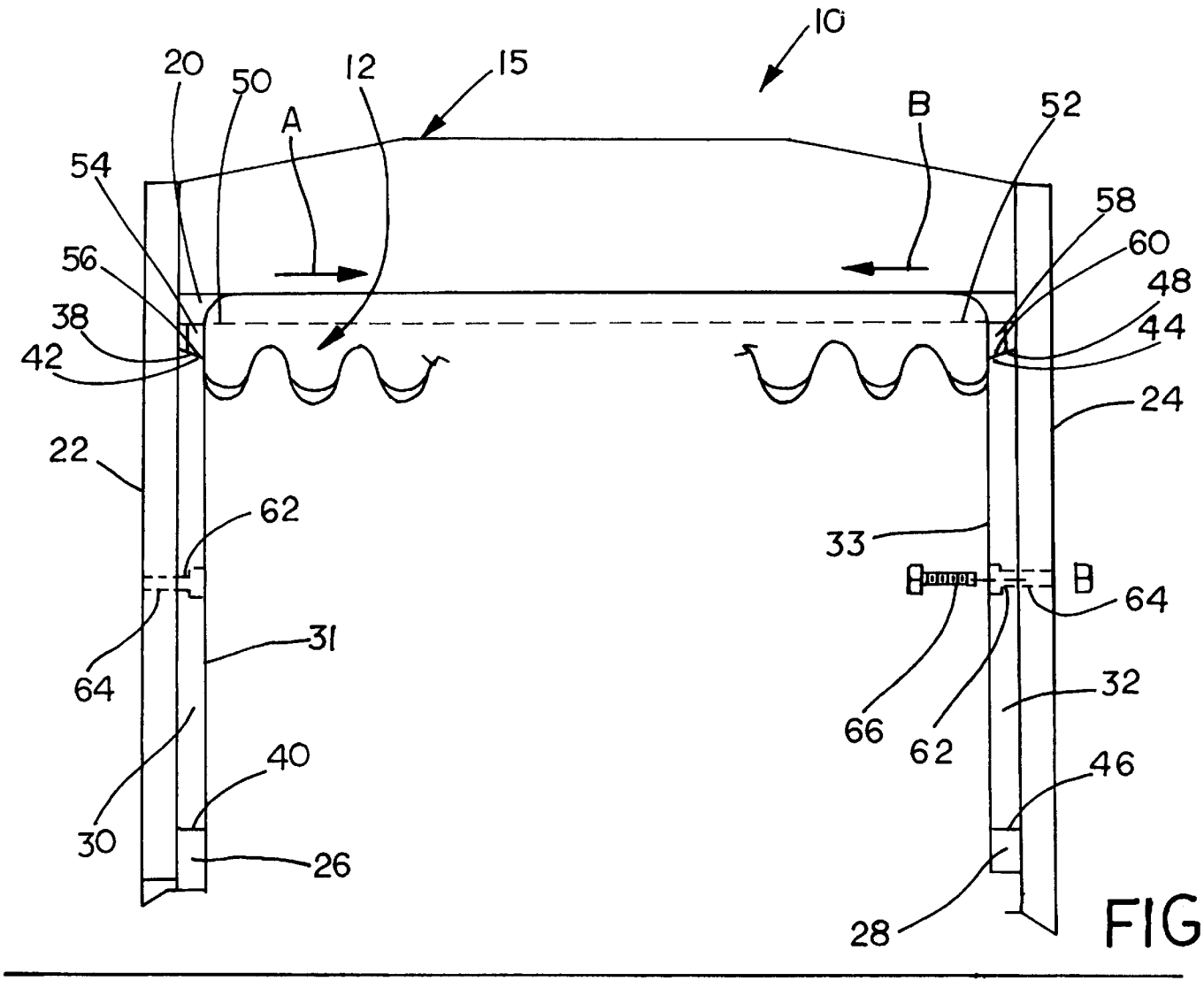
FIG. 3 is an enlarged fragmentary top plan view taken along line 3—3 of FIG. 2 and illustrating an arrangement constructed in accordance with the teachings of the present invention for securing the stationary jaw to the frame and for preventing side-to-side movement of the stationary jaw.
Figure 4:
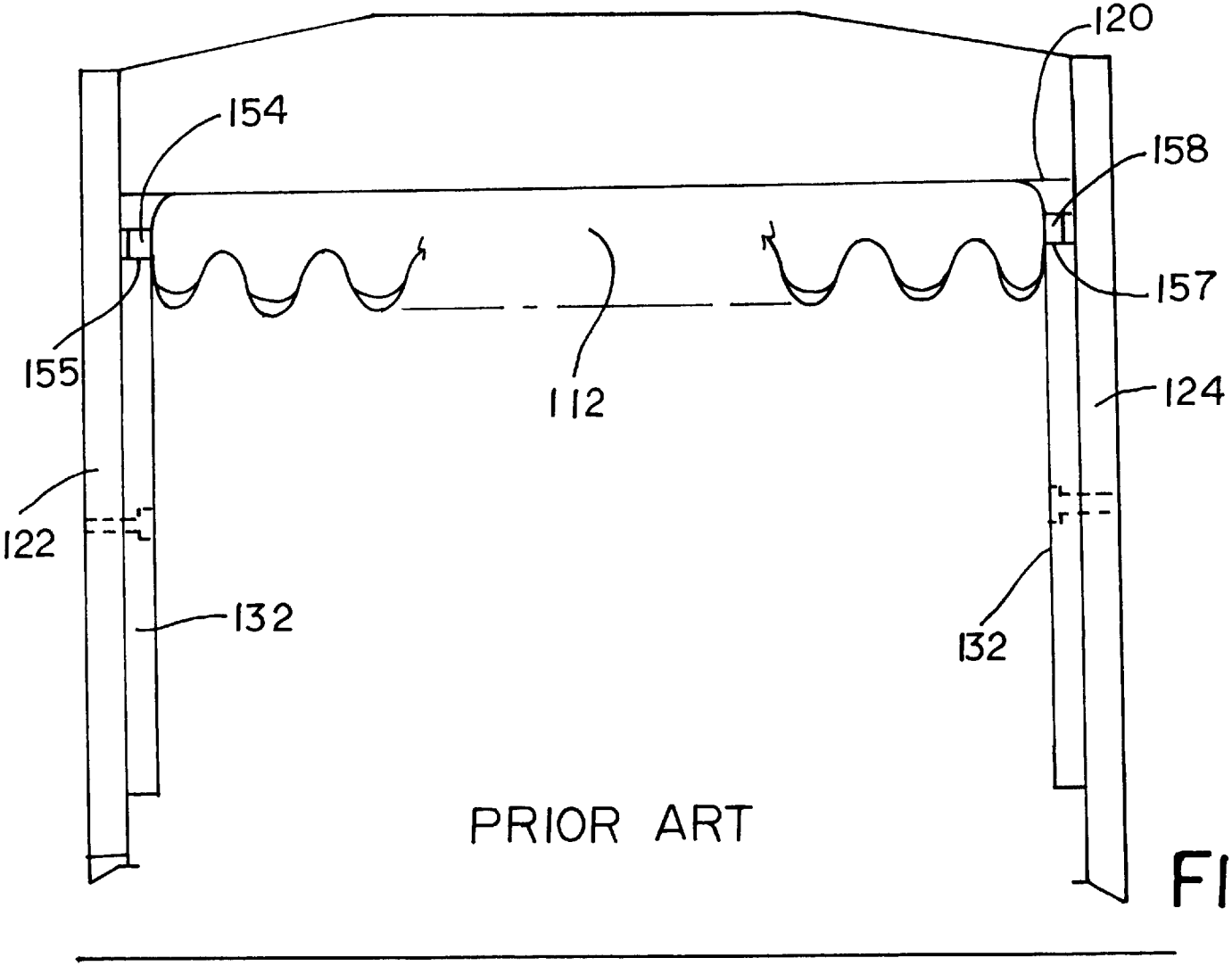
FIG.4 PRIOR ART
FIG. 4 is a fragmentary top plan view similar to FIG. 3 but illustrating a conventional prior art arrangement for securing the stationary jaw to the crusher frame.

Referring now to FIGS. 2 and 3, the frame 15 of the crusher 10 includes a generally vertical mounting base 20. Preferably, the mounting base is a vertically disposed steel plate of the type commonly employed in the art for such purposes. As outlined more fully in the above referenced co-pending application, the stationary jaw 12 typically includes an upper mounting lug 17 across the top of the jaw 12 and a lower mounting lug 19 across the bottom of the jaw 12, which lugs 17, 19 engage upper and lower portions 21, 23, respectively, of the mounting base 20.

The mounting base 20 extends between and is secured to a pair of opposing sidewalls 22, 24. A ledge 26, 28 is mounted to each of the sidewalls 22, 24, respectively. As shown in FIG. 2, the ledge 26 is spaced apart or away from the mounting base 20, and is further disposed at an angle relative to the mounting base 20. The ledge 28 attached to the opposite sidewall 24 is mounted and disposed in a similar manner. Preferably, the angled ledges 26, 28 are disposed at an angle of approximately fourteen degrees (14°) relative to the vertical, which is approximately fourteen degrees (14°) relative to a major vertical plane of the stationary jaw 12. Angular deviations therefrom may be contemplated based on design considerations. A wedge-shaped key plate 30, 32 is removably mounted to each sidewall 22, 24, respectively, in order to secure the stationary jaw 12 to the frame 15 in the manner to be described in greater detail below.

As shown in FIG. 2, the key plate 30 may be divided into an upper portion 34 and a lower portion 36 in order to permit ease of handling for the purposes of installation and removal. It will be understood that the key plate 32 may be divided in a similar manner. However, for the purposes of the following discussion it will be assumed that the key plates 30, 32 are each formed of a single piece of material, preferably steel plate.

The key plate 30 includes a first edge 38 disposed adjacent the stationary jaw 12, and further includes a second edge 40 disposed adjacent the ledge 26. The first edge 38 is generally vertically disposed and includes a bevel 42 (the bevel 42 being viewable in FIG. 3), while the second edge 40 is angled relative to the first edge 38. It will be understood that the angle of the second edge 40 relative to the first edge 38 generally matches the angle of the ledge 26 relative to the mounting base 20 (i.e., fourteen degrees (14°)). Similarly, the key plate 32 includes a first edge 44 disposed adjacent the stationary jaw 12, and further includes a second edge 46 disposed adjacent the ledge 28. The first edge 44 is generally vertically disposed and includes a bevel 48 (the bevel 48 being viewable in FIG. 3), while the second edge 46 is angled relative to the first edge 44. The angle of the second edge 46 relative to the first edge 44 generally matches the angle of the ledge 28 relative to the mounting base 20 (i.e., fourteen degrees (14°)).

The stationary jaw 12 includes a pair of opposing side edges 50, 52 which extend in a generally vertical direction when the stationary jaw 12 is disposed as shown in the drawings. The side edge 50 includes a side lug 54 extending substantially along the length thereof, with the side lug 54 including a bevel 56 (the bevel 56 being viewable in FIG. 3).

Similarly, the side edge 52 includes a lug 58 extending substantially along the length thereof, with the side lug 58 including a bevel 60 (the bevel 60 being viewable in FIG. 3). Preferably, the bevels 42, 48, 56 and 60 are constructed at a fifteen degree (15°) angle. It will be noted from FIG. 2 that the key plate 30 is generally wedge-shaped (with the shape of the key plate 32 being substantially the same). Each key plate 30, 32 includes a generally planar central portion 31, 33, respectively. Each central portion 31, 33 includes a plurality of elongated mounting slots 62, which slots 62 may be aligned with a plurality of mounting holes 64 in either of the sidewalls 22, 24. The elongated nature of the mounting slots 62 permit the up/down position of the key plates 30, 32 relative to their adjacent sidewalls 22, 24, respectively, to be adjustable. A plurality of fasteners 66, such as steel bolts or other suitable structural grade fasteners, may be used to secure the key plates 30, 32 to their adjacent sidewalls 22, 24.

As will be noted from FIG. 3, the angle of the bevel 42 on the first edge 38 of the key plate 30 matches the angle of the bevel 56 on the side lug 54 of the jaw 12. Similarly, the angle of the bevel 48 on the first edge 44 of the key plate 32 matches the angle of the bevel 60 on the lug 58 of the jaw 12. It will also be noted that the bevels 42 and 56 face one way, while the bevels 48 and 60 face the opposite way.

In operation, the stationary jaw 12 is mounted to the mounting base 20 such that the upper lug 17 engages the upper portion 21 of the mounting base 20, and the lower lug 19 engages the lower portion 23 of the mounting base 20. The stationary jaw 12 is then secured thereto against vertical movement in a conventional manner, or by employing the structure disclosed and claimed in the above referenced co-pending patent application.

In order to secure the stationary jaw 12 against side-to-side movement, the key plates 30, 32 are installed by lowering the key plates from above in a conventional manner. As the key plate 30 is lowered, the angled second edge 40 abuts the angled ledge 26, which applies a progressively greater force against the lug 54, thus forcing the jaw 12 against the mounting base 20 (in a generally upward direction when viewing FIG. 3, or generally to the left when viewing FIG. 2). The key plate 32 is lowered in a similar manner such that the angled second edge 46 abuts the ledge 28, thus applying a progressively greater force against the lug 58, also forcing the jaw 12 against the mounting base 20.

At the same time, the bevel 42 bears against the bevel 56, applying a force A (to the right when viewing FIG. 3) to the jaw 12. The bevel 48 bears against the bevel 60, applying a force B (to the left when viewing FIG. 3) to the jaw 12. Due to the balance of forces, force A and force B will be counteracting. Also by virtue of the angled edges 40, 46 bearing against their adjacent angled ledges 26, 28, the magnitude of the forces A and B may be increased in a stepless fashion by driving the key plates 26, 28 further downwardly. Accordingly, the required centering force can be achieved such that side-to-side movement of the jaw 12 during operation of the crusher 10 is prevented.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. The details of the structure may be varied substantially without departing from the spirit of the invention, and the exclusive use of all modifications which come within the scope of the appended claims is reserved.

What is claimed:

1. A jaw crusher, comprising:

a frame having a generally vertical base extending between a pair of spaced apart side portions, each of the side portions including an angled ledge spaced from the base;

a generally planar stationary jaw mounted to the base and extending between the frame side portions, the stationary jaw having a top edge, a bottom edge, and interconnecting side edges, each side edge having a beveled lug extending along a length thereof; and a pair of generally wedge shaped key plates, each of the key plates being mountable to an adjacent frame side portion and including a beveled first edge adapted to engage an adjacent beveled side lug of the stationary jaw, each of the key plates further including a second edge adapted to engage an adjacent ledge of the frame side portion;

whereby in response to downward movement of the key plates the stationary jaw is pressed generally horizontally against the frame base with the engaging beveled surfaces of the key plates and the side lugs preventing side-to-side movement of the stationary jaw.

2. The jaw crusher of claim 1, wherein each key plate is adapted for connection to its adjacent frame side portion.

3. The jaw crusher of claim 1, wherein each side lug bevel is angled to match the beveled first edge of its adjacent key plate.

4. The jaw crusher of claim 1, wherein each key plate is secured to its adjacent sidewall by a plurality of fasteners, and further wherein each key plate cooperates with its opposing key plate to apply a centering force to the stationary jaw.

5. The jaw crusher of claim 1, wherein each key plate bevel and its adjacent side lug bevel are adapted to provide a steplessly increasing centering force to the stationary jaw in response to downward movement of the key plate.

6. The jaw crusher of claim 1, wherein each key plate is divided into a top portion and a bottom portion, each top and bottom portion being independently mountable to its adjacent frame side portion.

7. A jaw crusher, comprising:

a frame having a mounting base extending between a pair of spaced apart sidewalls, each of the sidewalls including a ledge spaced from, and being angled relative to, the mounting base;

a stationary jaw mounted to the mounting base and extending between the frame sidewalls, the stationary jaw having a top edge, a bottom edge, and interconnecting side edges, a portion of each jaw side edge defining a beveled lug; and a pair of generally wedge shaped key plates, each key plate being vertically removably mounted to one of the frame sidewalls, each key plate including a beveled first edge adapted to engage an adjacent beveled side lug of the stationary jaw, each key plate further including a second edge adapted to engage an adjacent ledge of the frame sidewall, each key plate being downwardly moveable to thereby force the jaw against the mounting base, the beveled first edge of each key plate cooperating with its adjacent beveled side lug to thereby prevent side-to-side movement of the stationary jaw.

8. The jaw crusher of claim 7, wherein each key plate is adapted for connection to its adjacent frame sidewal.

9. The jaw crusher of claim 7, wherein each beveled lug is angled to match the beveled first edge of its adjacent key plate.

10. The jaw crusher of claim 7, wherein each key plate is secured to its adjacent sidewall by a plurality of fasteners, and further wherein each key plate cooperates with its opposing key plate to apply a centering force to the stationary jaw.

11. The jaw crusher of claim 7, wherein each key plate beveled first edge and its adjacent beveled lug are adapted to provide a steplessly increasing centering force to the stationary jaw in response to downward movement of the key plates.

12. The jaw crusher of claim 7, wherein each key plate is divided into a top portion and a bottom portion, each top and bottom portion being independently mountable to its adjacent frame sidewall.

13. A jaw crusher, comprising:

a frame having a generally vertical mounting base extending between a pair of spaced apart sidewalls, each of the sidewalls including a ledge spaced from and angled relative to the mounting base;

a stationary jaw mounted to the mounting base and extending between the frame sidewalls, the stationary jaw having a top edge, a bottom edge, and interconnecting side edges, and a pair of generally wedge shaped key plates, each key plate being vertically removably mounted to one of the frame sidewalls so as to engage one of the jaw side edges and an adjacent one of the sidewall ledges; and means carried by cooperating and engaging portions of each key plate and each jaw side edge for applying a stepless and progressively greater centering force to the jaw in response to downward movement of the key plates.

14. On a jaw crusher having a frame, a stationary jaw, and a pair of key plates adapted for vertically sliding engagement with opposing sidewalls of the frame for securing the stationary jaw to the frame, a method of applying a centering force to the stationary jaw comprising the steps of:

providing a beveled first edge on each of the key plates;

providing a beveled side lug on opposing sides of the stationary jaw;

sliding each key plate into engagement with the frame such that each beveled first edge engages an adjacent beveled side lug of the stationary jaw; and securing each key plate to its adjacent frame sidewall.

15. The method of claim 14, including the additional step of applying a progressively greater downward force to each key plate, thereby providing a steplessly greater centering force to the stationary jaw.

* * * * *